US011495925B2

(12) United States Patent
Maejima et al.

(10) Patent No.: US 11,495,925 B2
(45) Date of Patent: Nov. 8, 2022

(54) CONNECTOR

(71) Applicant: YAZAKI CORPORATION, Tokyo (JP)

(72) Inventors: Toshiro Maejima, Makinohara (JP); Kouichirou Matsushita, Makinohara (JP); Takuya Otake, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/329,541

(22) Filed: May 25, 2021

(65) Prior Publication Data

US 2021/0376543 A1 Dec. 2, 2021

(30) Foreign Application Priority Data

May 27, 2020 (JP) ..... JP2020-092496

(51) Int. Cl.
*H01R 24/38* (2011.01)
*H01R 24/50* (2011.01)
(Continued)

(52) U.S. Cl.
CPC ..... *H01R 24/50* (2013.01); *H01R 13/64* (2013.01); *H01R 13/6583* (2013.01)

(58) Field of Classification Search
CPC .... H01R 24/50; H01R 13/64; H01R 13/6583; H01R 13/6594; H01R 43/16;
(Continued)

(56) References Cited

U.S. PATENT DOCUMENTS

2016/0172778 A1* 6/2016 Endo ..... H01R 13/11 439/733.1
2017/0110838 A1* 4/2017 Sasaki ..... H01R 4/20
(Continued)

FOREIGN PATENT DOCUMENTS

JP 57-152778 U 9/1982
JP 60-193674 U 12/1985
(Continued)

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

A connector includes: a cylindrical terminal; an internal terminal; and a housing. The cylindrical terminal has an engagement portion of its one edge portion and its opposite other edge portion. The one edge portion has a first reduced thickness portion at its circumferential end portion. The first reduced thickness portion has a first protrusion protruding inwardly in a radial direction and extending in an axial direction. The other edge portion has a second reduced thickness portion. The second reduced thickness portion has a second protrusion protruding outwardly in the radial direction and extending in the axial direction. The engagement portion is configured by overlapping the first reduced thickness portion and the second reduced thickness portion and further by locating the first protrusion and the second protrusion to face each other in the circumferential direction to allow an engagement between them in the circumferential direction.

5 Claims, 8 Drawing Sheets

(51) Int. Cl.
*H01R 13/6583* (2011.01)
*H01R 13/64* (2006.01)

(58) Field of Classification Search
CPC .. H01R 2103/00; H01R 13/02; H01R 12/716; H01R 12/75; H01R 13/639; H01R 13/6581; H01R 24/005
See application file for complete search history.

(56) References Cited

U.S. PATENT DOCUMENTS

| | | | | |
|---|---|---|---|---|
| 2017/0214191 | A1 | 7/2017 | Lane | |
| 2021/0376539 | A1* | 12/2021 | Maejima | H01R 13/6594 |
| 2021/0376543 | A1* | 12/2021 | Maejima | H01R 13/64 |
| 2022/0029336 | A1* | 1/2022 | Sundarakrishnamachari | H01R 13/4223 |
| 2022/0166174 | A1* | 5/2022 | Uki | H01R 24/66 |

FOREIGN PATENT DOCUMENTS

| | | | |
|---|---|---|---|
| JP | 2011-113858 | A | 6/2011 |
| JP | 2019-503055 | A | 1/2019 |

* cited by examiner

CONNECTOR

CROSS-REFERENCE TO RELATED APPLICATIONS

This application is based on and claims priority under 35 USC 119 from Japanese Patent Application No. 2020-092496 filed on May 27, 2020, the contents of which are incorporated herein by reference.

TECHNICAL FIELD

The present invention relates to a connector.

BACKGROUND ART

In the related art, there is proposed a connector that has a high shielding property and is used for the purpose of being connected to a coaxial cable or the like. For example, in a connector in the related art, a periphery of a terminal portion is covered with a metal tube, so that electromagnetic waves emitted from an outside of the connector toward the terminal portion and electromagnetic waves emitted from the terminal portion to the outside are shielded (collected). The metal tube has a structure in which a metal plate member is bent into a cylindrical shape so that one and the other edge portions of the plate member are overlapped with each other. The edge portions overlapped with each other in this manner, so as to prevent a decrease in shielding performance at a joint of the edge portions.

As for details of the above connector, refer to JP 2011-113858 A.

The connector in the related art as described above has a stepped shape that protrudes radially outward at the joint described above due to the overlapping of the edge portions of the plate member. Therefore, when the metal tube is actually assembled to a housing, for example, it is required to provide a recess or the like corresponding to the above-described stepped shape on an inner wall surface of an insertion hole provided in the housing. In other words, a structure of a mold or the like for manufacturing the housing is complicated, and it is difficult to improve productivity of the housing (and the connector). In this manner, it is difficult to achieve both the shielding performance and the productivity of the connector in the related art.

SUMMARY OF INVENTION

Aspect of non-limiting embodiments of the present disclosure relates to provide a connector capable of achieving both excellent shielding performance and improved productivity.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a connector comprising:

a cylindrical terminal to be electrically connected with a cylindrical counterpart terminal;

an internal terminal located in the cylindrical terminal; and a housing holding the cylindrical terminal, the cylindrical terminal having an engagement portion configured by bending a conductor having a plate-shape into a cylindrical shape to engage one edge portion of the conductor and an opposite other edge portion of the conductor, the one edge portion having a recessed shape at its circumferential end portion by reducing its thickness outwardly in a radial direction of the cylindrical terminal to configure a first reduced thickness portion, the first reduced thickness portion having a first protrusion protruding inwardly in the radial direction and extending in an axial direction of the cylindrical terminal, the other edge portion having a recessed shape at its circumferential end portion by reducing its thickness inwardly in the radial direction to configure a second reduced thickness portion, the second reduced thickness portion having a second protrusion protruding outwardly in the radial direction and extending in the axial direction, the engagement portion being configured by overlapping the first reduced thickness portion and the second reduced thickness portion in the radial direction and further by locating the first protrusion and the second protrusion to face each other in the circumferential direction to allow an engagement between the first protrusion and the second protrusion in the circumferential direction.

BRIEF DESCRIPTION OF DRAWINGS

Exemplary embodiment(s) of the present invention will be described in detail based on the following figures, wherein.

DESCRIPTION OF EMBODIMENTS

Figure 1:
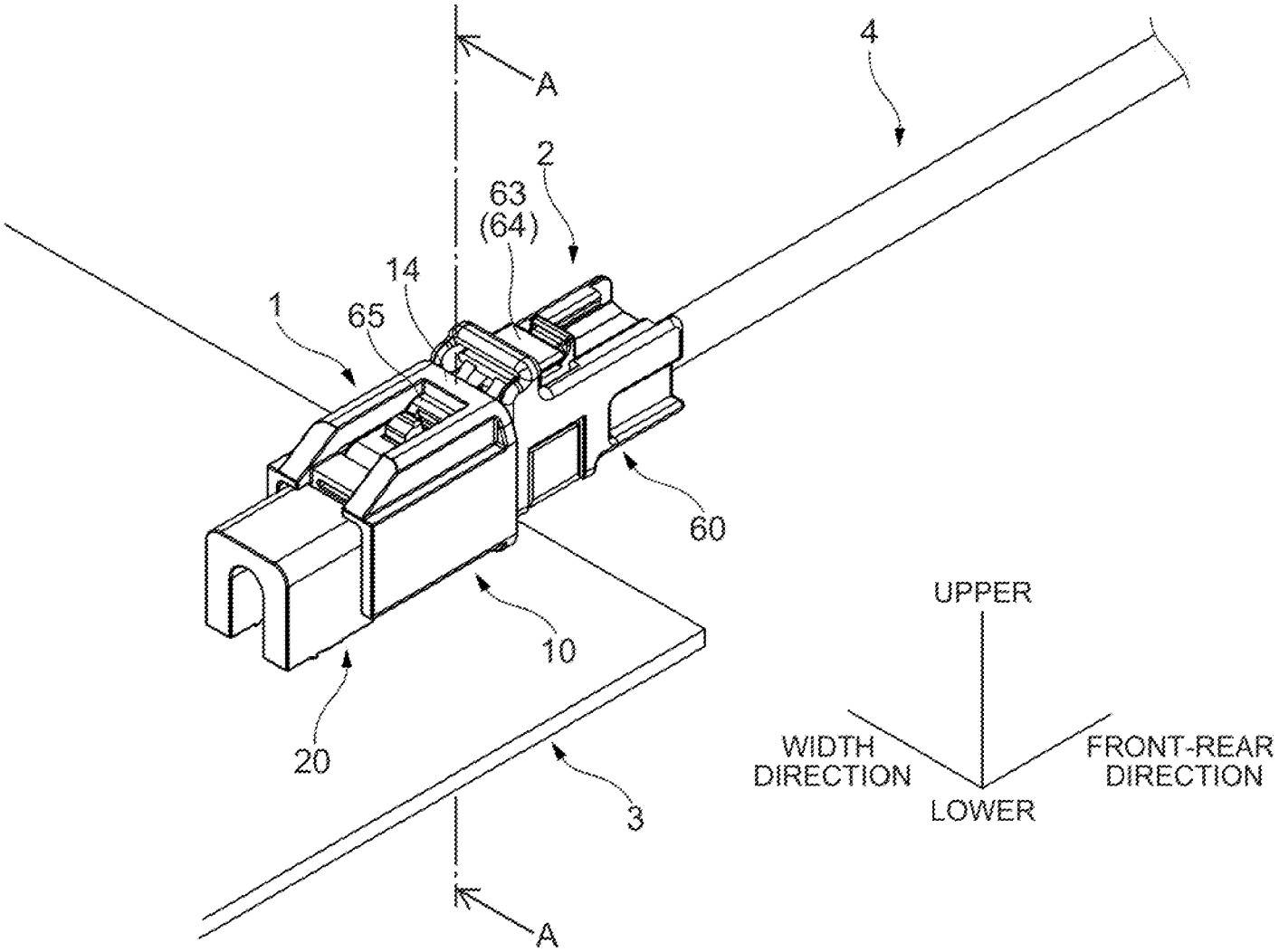
FIG. 1 is a perspective view showing a state in which a connector and a counterpart connector are fitted to each other according to an embodiment of the present invention.
Figure 2:
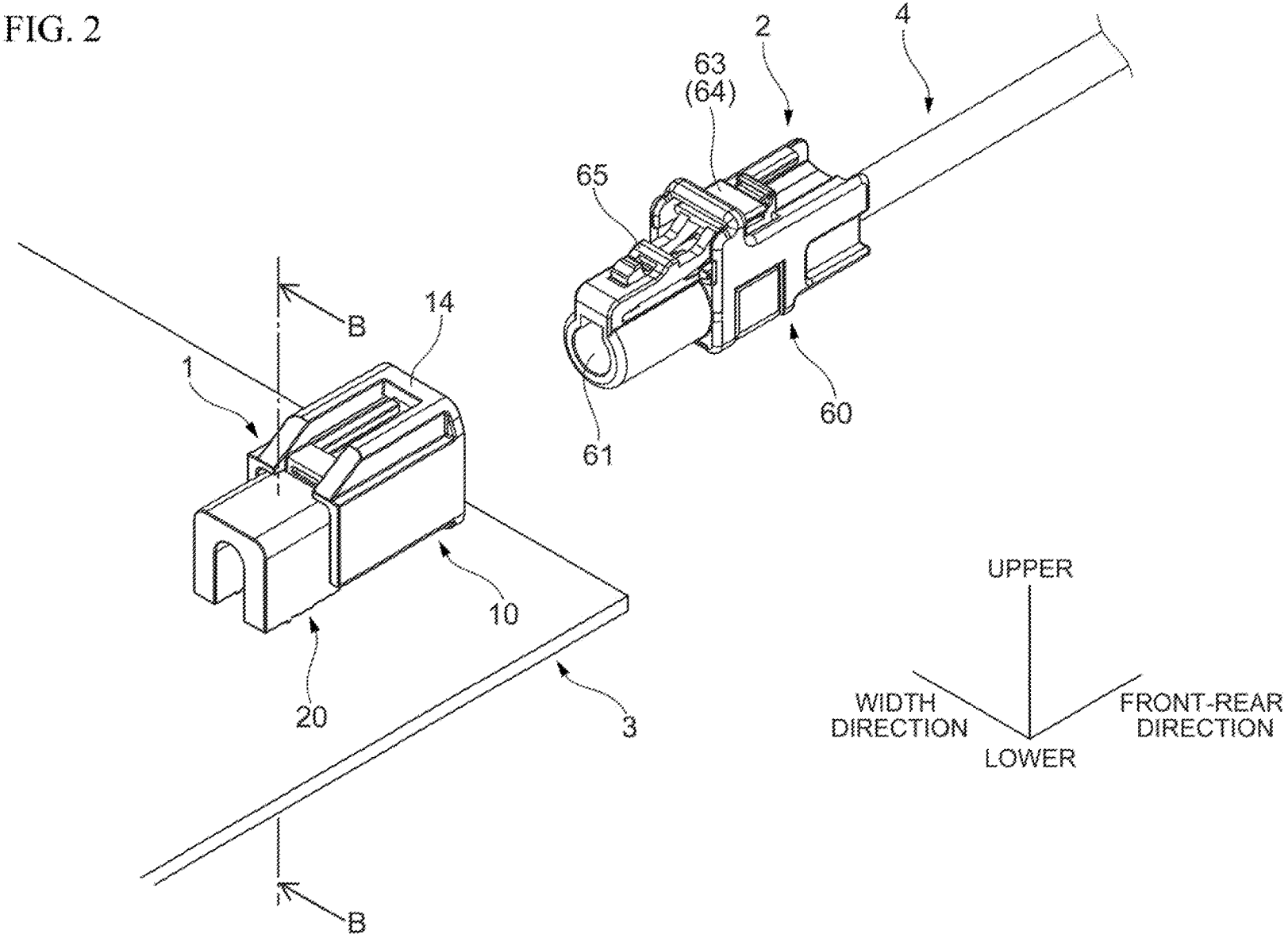
FIG. 2 is a perspective view showing a state in which the connector and the counterpart connector are separated from each other according to the embodiment of the present invention.

Hereinafter, a connector 1 according to an embodiment of the present invention will be described with reference to the drawings. As shown in FIGS. 1 and 2, a male housing 10 of the connector 1 can be fitted to a female housing 60 of a counterpart connector 2. The connector 1 is a male connector mounted on a circuit board 3, and is also referred to as a printed circuit board connector (PCB connector). The counterpart connector 2 is a female connector connected to a coaxial wire 4 that transmits a high-frequency signal or the like. Both the connector 1 and the counterpart connector 2 have a shielding function of preventing leakage of electromagnetic waves caused by the signal transmitted by the coaxial wire 4 and preventing the electromagnetic waves from entering the connector 1 and the counterpart connector 2 from the outside. The male housing 10 corresponds to a "housing" in the present invention.

Figure 3:
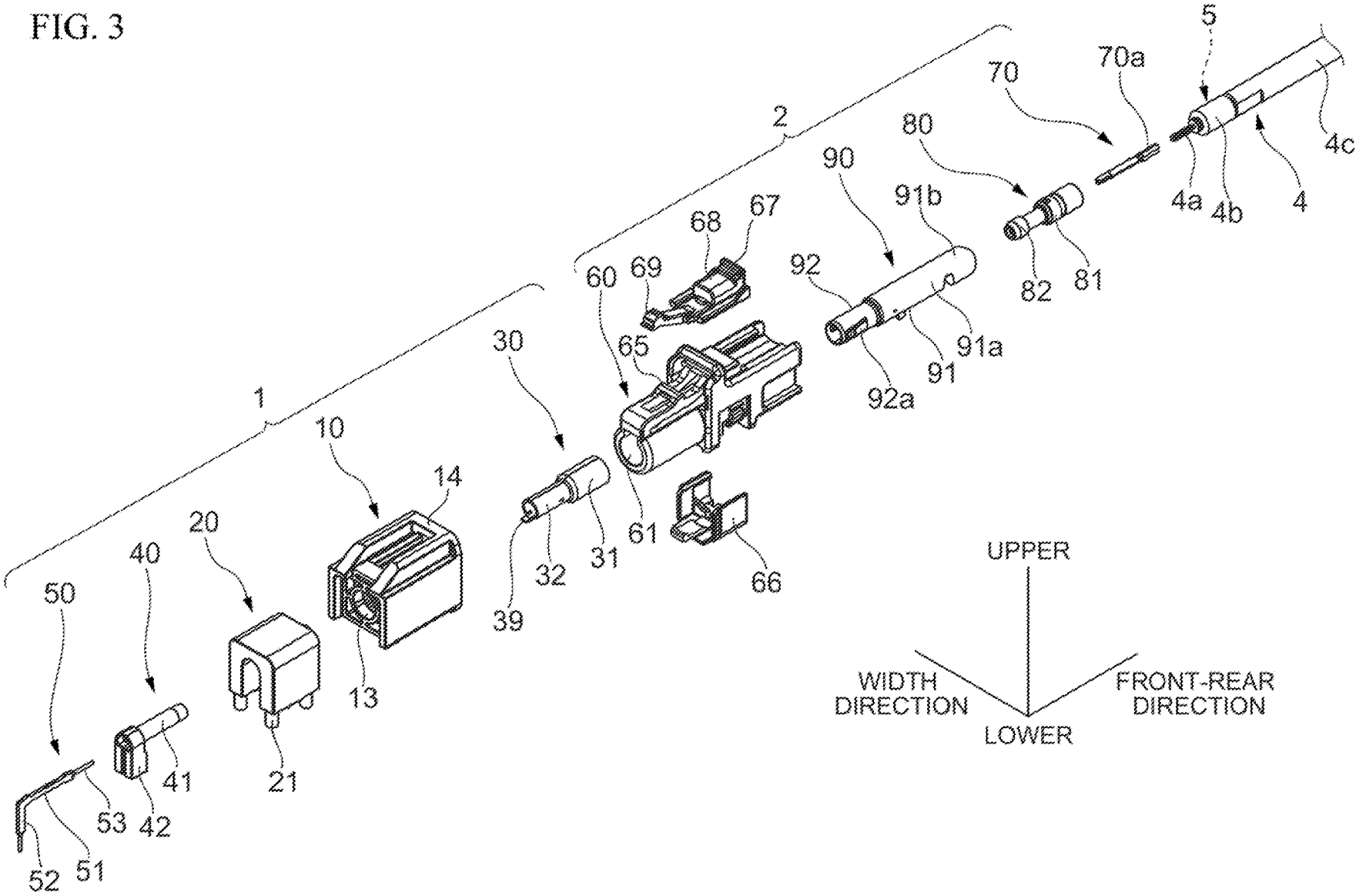
FIG. 3 is an exploded perspective view showing the connector and the counterpart connector according to the embodiment of the present invention.

Hereinafter, for the convenience of description, a "front-rear direction", a "width direction", an "upper-lower direction", "upper", and "lower" are defined as shown in FIGS. 1 to 3 and the like. The "front-rear direction", the "width direction", and the "upper-lower direction" are orthogonal to one another. The front-rear direction coincides with a fitting direction of the connector 1 and the counterpart connector 2. For the connector 1 and the counterpart connector 2, a front face side in a fitting direction in which the counterpart connector is fitted is referred to as a front side, and a rear face side in the fitting direction opposite to the front side is referred to as a rear side.

As shown in FIG. 3, the connector 1 includes the male housing 10, a shield shell 20, a male outer terminal 30, a male guide sleeve 40, and a male inner terminal 50. The counterpart connector 2 includes the female housing 60, a female inner terminal 70, a female guide sleeve 80, and a female outer terminal 90. Hereinafter, first, members constituting the connector 1 will be described. The male outer terminal 30 corresponds to a "cylindrical terminal" in the present invention. Similarly, the male inner terminal 50 corresponds to an "internal terminal", and the female outer terminal 90 corresponds to a "counterpart terminal".

Figure 4:
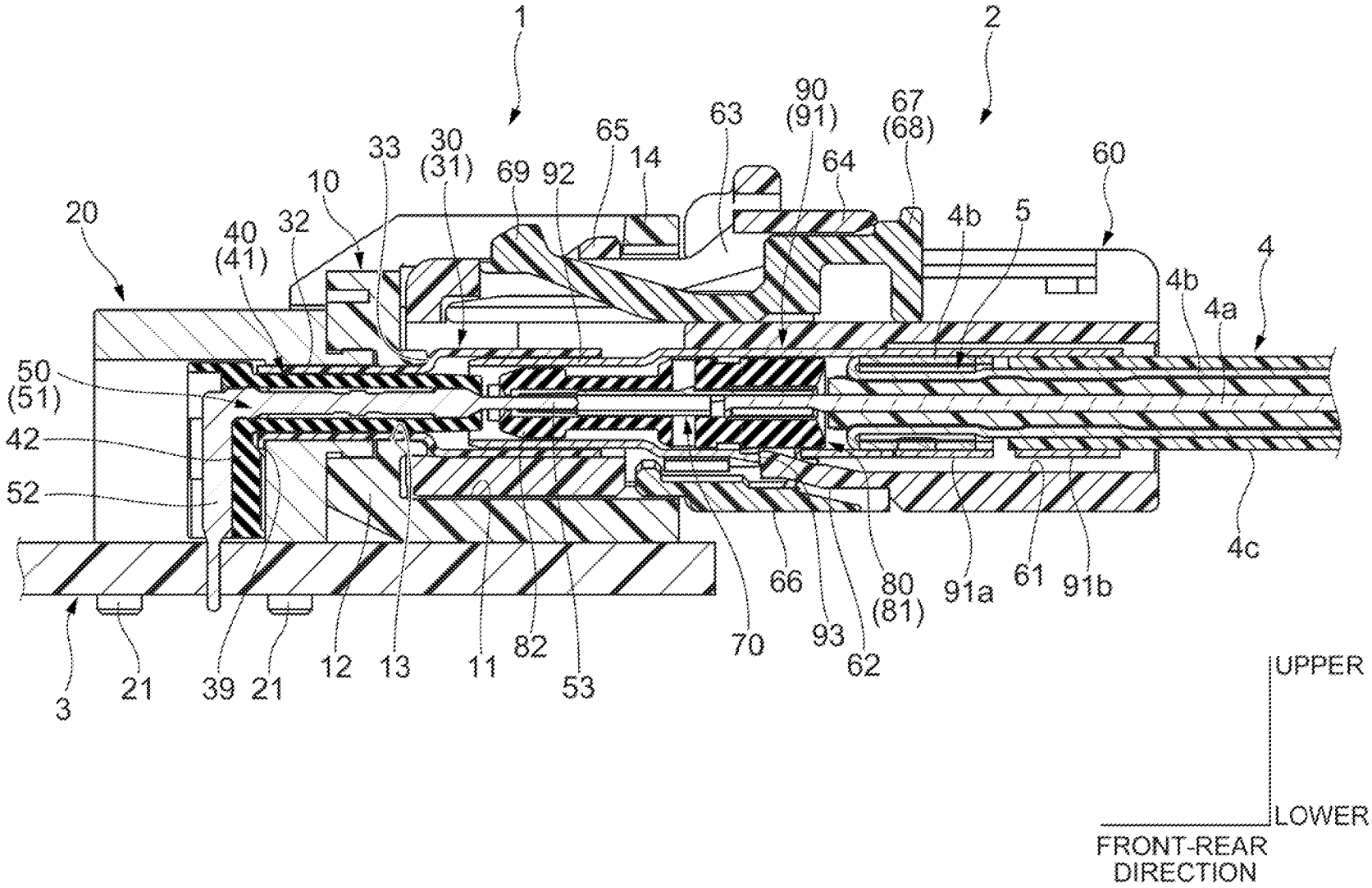
FIG. 4 is a cross-sectional view taken along a line A-A in FIG. 1.
Figure 5:
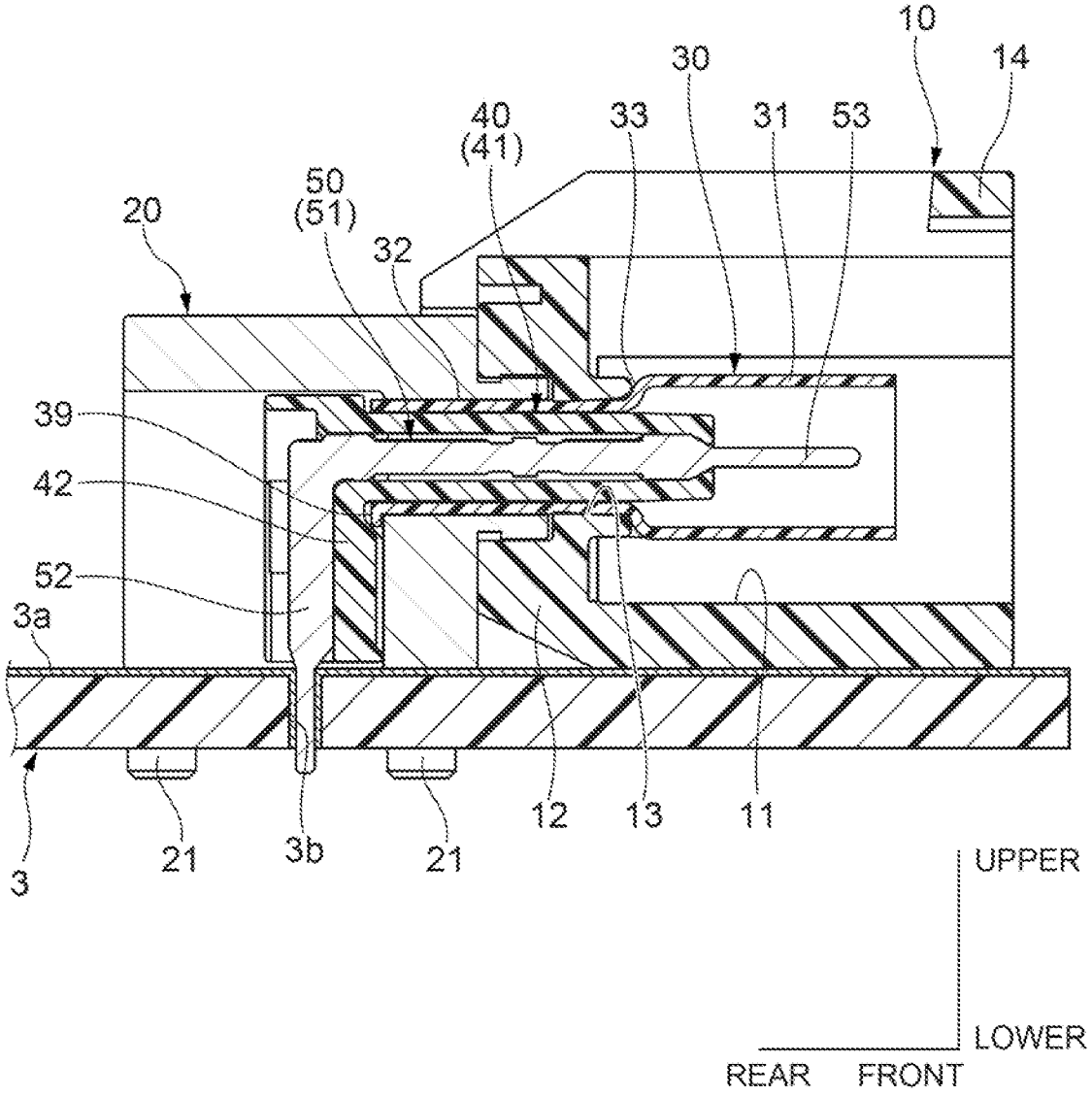
FIG. 5 is a cross-sectional view taken along a line B-B in FIG. 2.

First, the male housing 10 will be described. The male housing 10 formed of a resin has a shape extending in the front-rear direction. As shown in FIGS. 4 and 5, a fitting recessed portion 11 that opens forward and is recessed rearward is formed inside the male housing 10. The female housing 60 is fitted into the fitting recessed portion 11 from the front side. A male terminal accommodating hole 13 that has a circular cross section and passes through a rear wall portion 12 of the male housing 10 in the front-rear direction is formed in the rear wall portion 12 of the male housing 10. The rear wall portion 12 forms a bottom wall of the fitting recessed portion 11. The male outer terminal 30 is inserted into the male terminal accommodating hole 13 from the front side. As will be described later, a locking piece 39 provided at the rear side of the male outer terminal 30 is bent downward and locked to the shield shell 20. A rear surface of the rear wall portion 12 is formed into a fitting shape to which the shield shell 20 can be fitted from the rear side.

A lock portion 14 extending in the width direction is provided on an upper portion of a front end portion of the male housing 10. When the male housing 10 and the female housing 60 are fitted to each other, the lock portion 14 is engaged with a locking portion 65 of a lock arm 63 (to be described later) provided in the female housing 60 (see also FIGS. 1 and 2).

Next, the shield shell 20 will be described. The shield shell 20 is formed by die casting of aluminum, and is a member that exhibits the above-described shielding function of the connector 1. The shield shell 20 has a substantially U shape that opens downward as viewed in the front-rear direction, and has a shape extending in the front-rear direction.

A front end portion of the shield shell 20 has a shape corresponding to the above-described fitting shape of the rear wall portion 12 of the male housing 10. The shield shell 20 is assembled to the rear wall portion 12 of the male housing 10 from the rear side. A leg portion 21 protruding downward is formed at each of four corners of a lower end portion of the shield shell 20. A plurality of leg portions 21 are inserted into through holes (not shown) corresponding to ground portions formed in the circuit board 3 and the leg portions 21 are soldered (see also FIGS. 4 and 5). Accordingly, the shield shell 20 is fixed to the circuit board 3 (see also FIGS. 1 and 2).

Figure 6A:
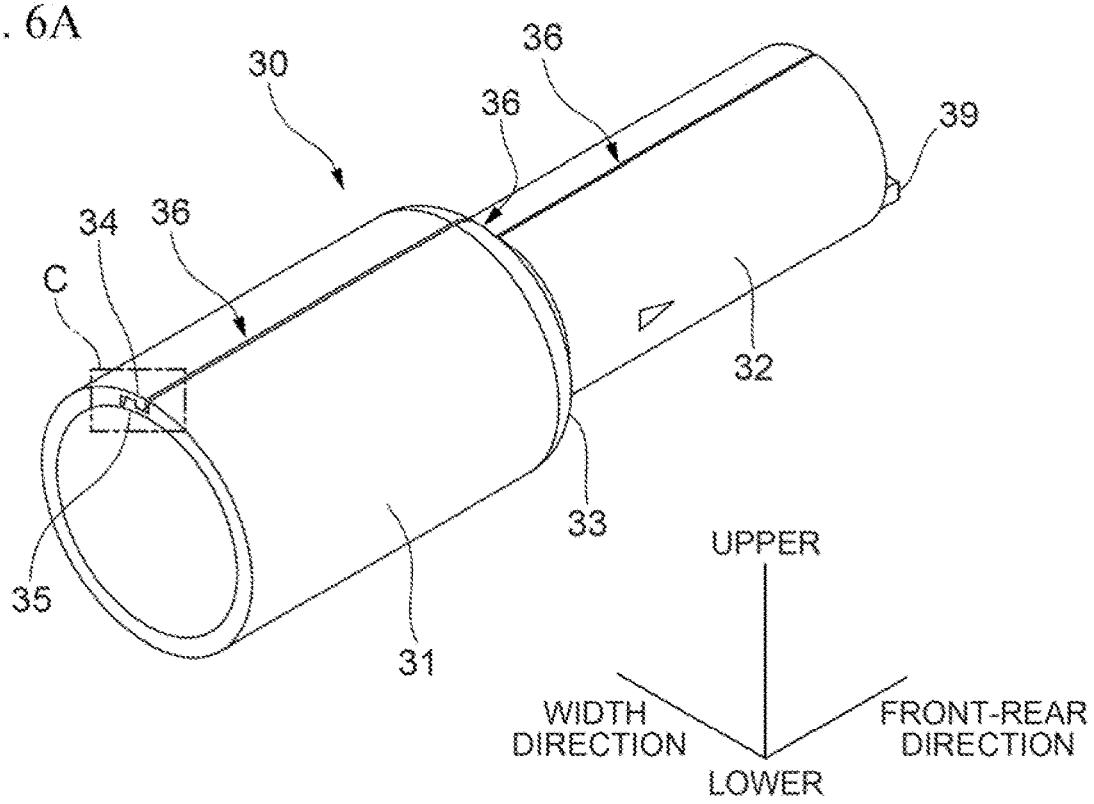
FIG. 6A is a perspective view showing a male outer terminal as viewed from a front side and FIG. 6B is a perspective view showing the male outer terminal as viewed from a rear side.
Figure 6B:
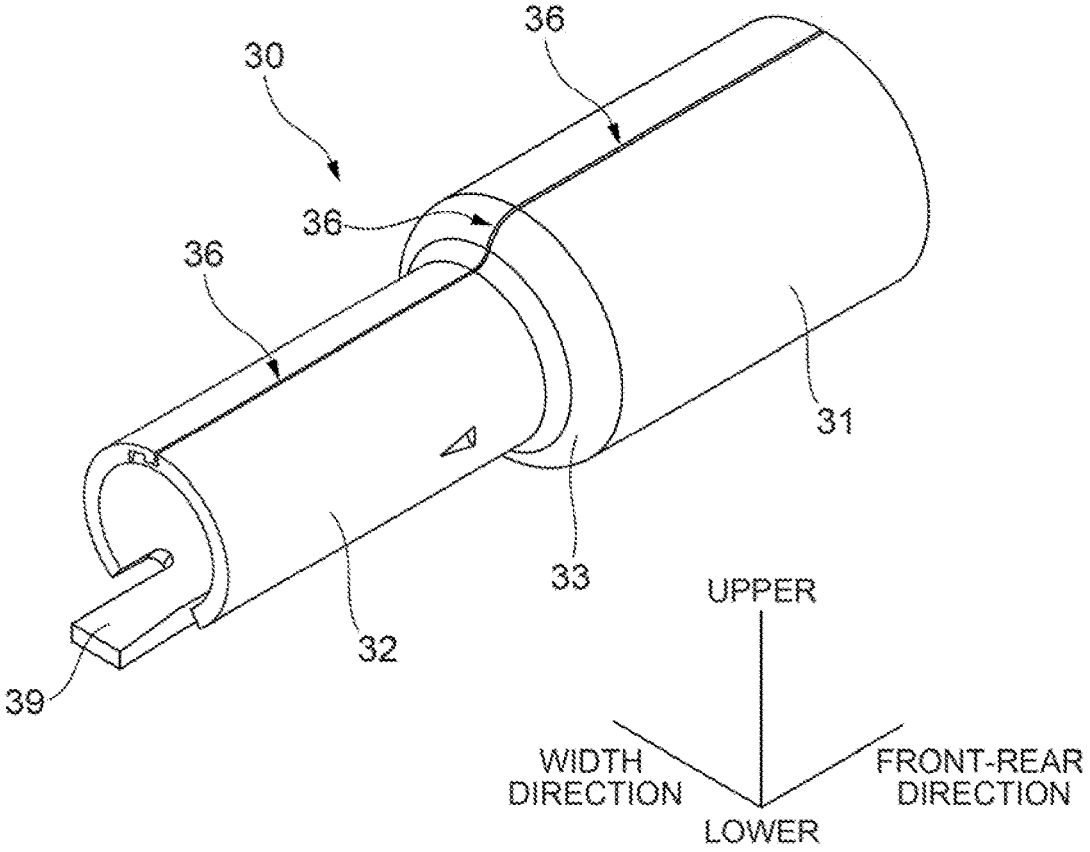

Next, the male outer terminal 30 will be described. As shown in FIGS. 6A and 6B, the male outer terminal 30 has a stepped cylindrical shape extending in the front-rear direction. The male outer terminal 30 includes a cylindrical large diameter portion 31 located at the front side, a cylindrical small diameter portion 32 located at the rear side and having a smaller diameter than the large diameter portion 31, and a connection portion 33 located between the large diameter portion 31 and the small diameter portion 32 and having a diameter gradually decreasing from the large diameter portion 31 toward the small diameter portion 32. The male outer terminal 30 is also a member that exhibits the above-described shielding function of the connector 1. An outer diameter of the large diameter portion 31 is substantially equal to an inner diameter of a female terminal accommodating hole 61 (to be described later) of the female housing 60, and the large diameter portion 31 can be inserted into the female terminal accommodating hole 61 (see FIG. 4).

Figure 8A:
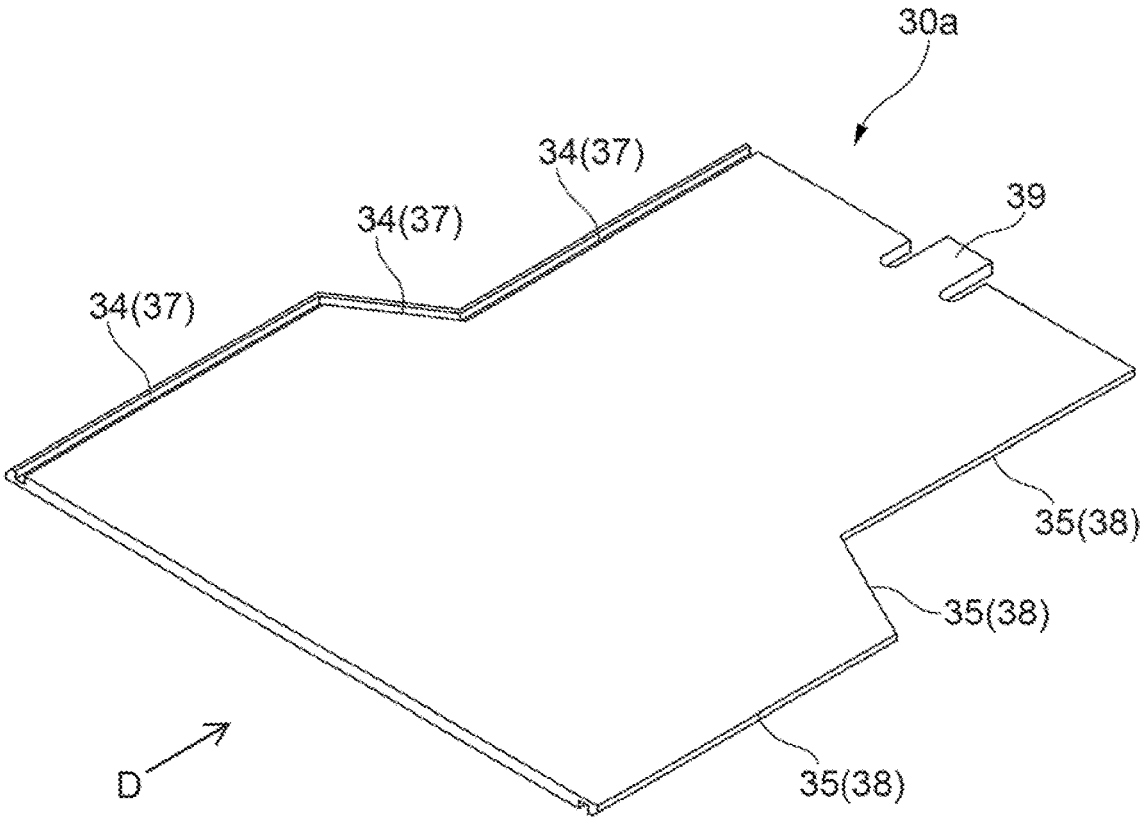
FIG. 8A is a perspective view showing a flat plate-shaped conductor used for manufacturing the male outer terminal.
Figure 8B:
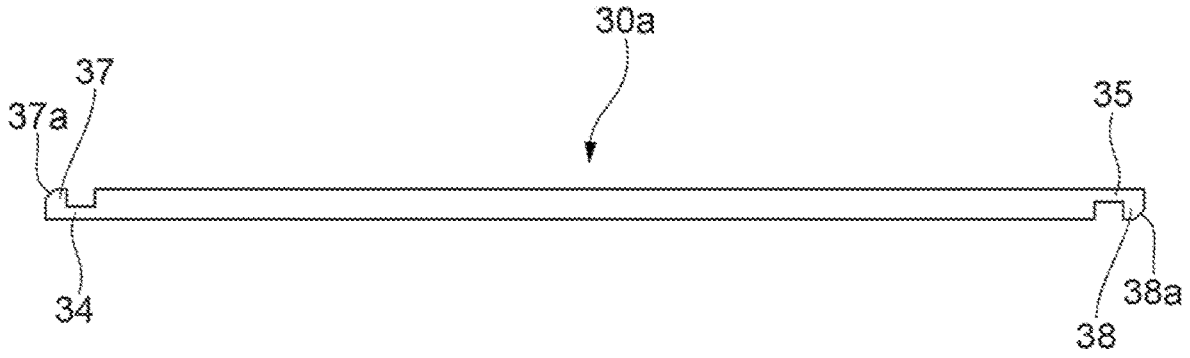
FIG. 8B is a front view showing the flat plate-shaped conductor.

The male outer terminal 30 is formed by bending a flat plate-shaped conductor 30*a* shown in FIGS. 8A and 8B into a stepped cylindrical shape and forming, in the front-rear direction, an engagement portion 36 (see FIG. 6) that is formed by engaging one and the other edge portions of the conductor 30*a* extending in the front-rear direction with each other. As shown in FIGS. 6A and 6B, the engagement portion 36 extends in the front-rear direction at an upper end position in a circumferential direction of the male outer terminal 30.

A lower end portion of a rear end surface of the small diameter portion 32 is formed with a locking piece 39 protruding rearward from the lower end portion. When the connector 1 is assembled, a rear end portion of the locking piece 39 is bent downward and locked to the shield shell 20, and is inserted into a predetermined locking hole of the male guide sleeve 40 (see FIGS. 4 and 5). Accordingly, the male outer terminal 30 is prevented from rotating in the circumferential direction relative to the male housing 10, and a position of the male outer terminal 30 in the circumferential direction is defined such that the engagement portion 36 is maintained at the upper end position in the circumferential direction of the male outer terminal 30.

Next, the male guide sleeve 40 will be described. As shown in FIGS. 3 to 5, the male guide sleeve 40 formed of an insulating resin integrally includes a cylindrical body portion 41 extending in the front-rear direction and a hanging portion 42 hanging downward from a rear end portion of the body portion 41.

A body portion 51 (which will be described later) of the male inner terminal 50 is inserted into the body portion 41 from the rear side. Further, the body portion 41 is inserted into the small diameter portion 32 of the male outer terminal 30 from the rear side. Accordingly, the body portion 41 functions to insulate the male inner terminal 50 and the male outer terminal 30 from each other, and to maintain a state in which the male inner terminal 50 and the male outer terminal 30 are arranged coaxially.

Next, the male inner terminal 50 will be described. The male inner terminal 50 formed of a metal integrally includes a rod shaped body portion 51 extending in the front-rear direction and a rod shaped hanging portion 52 hanging downward from a rear end portion of the body portion 51. A front end portion of the body portion 51 serves as a tip end portion 53 whose diameter is reduced compared with the other portion of the body portion 51. The tip end portion 53 is connected to the female inner terminal 70 when the male housing 10 and the female housing 60 are fitted to each other (see FIG. 4). The hanging portion 52 is inserted into a through hole 3*b* connected to a conductor pattern 3*a* formed on an upper surface of the circuit board 3 (see FIG. 5). Accordingly, the male inner terminal 50 is electrically connected to the circuit board 3.

Next, an assembly procedure of the connector 1 will be described. In order to assemble the connector 1, first, the shield shell 20 is assembled to the rear wall portion 12 of the male housing 10 from the rear side. Next, the small diameter portion 32 of the male outer terminal 30 is inserted into the male terminal accommodating hole 13 of the male housing 10 from the front side. This insertion is continued until the connection portion 33 of the male outer terminal 30 comes into contact with a front edge portion of the male terminal accommodating hole 13. Then, the rear end portion of the locking piece 39 is bent downward and locked to the shield shell 20. As a result, the large diameter portion 31 of the male outer terminal 30 is positioned inside the fitting recessed portion 11 of the male housing 10, and the small diameter portion 32 of the male outer terminal 30 comes into contact with a predetermined portion of the shield shell 20 inside the shield shell 20.

Next, the body portion 51 of the male inner terminal 50 is press-fitted into the body portion 41 of the male guide sleeve 40 from the rear side. The press-fitting is continued until the hanging portion 52 of the male inner terminal 50 comes into contact with the hanging portion 42 of the male guide sleeve 40. As a result, the tip end portion 53 of the male inner terminal 50 protrudes forward from a front end opening of the body portion 41 of the male guide sleeve 40.

Next, the body portion 41 of the male guide sleeve 40 into which the male inner terminal 50 is press-fitted is press-fitted into the small diameter portion 32 of the male outer terminal 30 from the rear side. The press-fitting is continued until a predetermined portion of the male guide sleeve 40 comes into contact with a predetermined portion of the shield shell 20. As a result, the tip end portion 53 of the male inner terminal 50 is positioned inside the large diameter portion 31 of the male outer terminal 30. Further, the body portion 51 of the male inner terminal 50 is covered with the male outer terminal 30, and the hanging portion 52 of the male inner terminal 50 is covered with the shield shell 20. As a result, the shield shell 20 and the male outer terminal 30 exhibit a shielding function against the male inner terminal 50. Then, the assembly of the connector 1 is completed.

The assembled connector 1 is mounted on the circuit board 3 as shown in FIGS. 1, 2, 4, and 5. When the connector 1 is mounted on the circuit board 3, a bottom surface of the male housing 10 is fixed to a predetermined portion of the upper surface of the circuit board 3, the plurality of leg portions 21 of the shield shell 20 are inserted into the through holes corresponding to the ground portions formed in the circuit board 3 and the leg portions 21 are soldered, and a tip end portion of the hanging portion 52 of the male inner terminal 50 is inserted into the through hole 3*b* (see FIG. 5) formed in the circuit board 3 and the tip end portion of the hanging portion 52 is soldered.

As a result, a high-frequency signal transmitted from the male inner terminal 50 is transmitted to the conductor pattern 3*a* of the circuit board 3. Further, a minute current generated in the shield shell 20 and the male outer terminal 30 when the shield shell 20 and the male outer terminal 30 shield (collect) electromagnetic waves is grounded to the ground portions of the circuit board 3. The connector 1 is described as above.

Next, members constituting the counterpart connector 2 will be described. First, the female housing 60 will be described. The female housing 60 formed of a resin has a shape extending in the front-rear direction. As shown in FIG. 4, the female terminal accommodating hole 61 passing through the female housing 60 in the front-rear direction is formed inside the female housing 60 (see also FIG. 2). The female outer terminal 90 is inserted into the female terminal accommodating hole 61 from the rear side.

A lance 62 extends forward in a cantilever shape so as to face the female terminal accommodating hole 61 and the lance 62 is formed at a lower portion of a substantially central portion in the front-rear direction of the female terminal accommodating hole 61. The lance 62 is elastically deformable in the upper-lower direction and engages with a lance locking hole 93 (to be described later) of the female outer terminal 90 to exhibit a function of preventing the female outer terminal 90 from coming off to a rear side.

As shown in FIGS. 2 and 4, the lock arm 63 extending rearward in a cantilever shape is formed on an upper portion of the female housing 60. The lock arm 63 is elastically deformable in the upper-lower direction, and an extended end portion (rear end portion) of the lock arm 63 functions as an operation portion 64 to be operated by an operator. A locking portion 65 that is a protrusion protruding upward and extending in the width direction is formed at a central portion in the front-rear direction of the lock arm 63.

As shown in FIGS. 3 and 4, a side holder 66 is attached to a lower portion of the female housing 60 from below so as to cover the lance 62 from below. As shown in FIGS. 3 and 4, a fitting assurance member 67 is attached to the upper portion of the female housing 60 from the rear side so that the fitting assurance member 67 enters a lower space of the lock arm 63. Functions of the side holder 66 and the fitting assurance member 67 will be described later.

Next, the female inner terminal 70 will be described. As shown in FIGS. 3 and 4, the female inner terminal 70 formed of a metal has a cylindrical shape extending in the front-rear direction. An internal conductor connection portion 70*a* is provided at a rear side of the female inner terminal 70. A linear internal conductor 4*a* (see FIG. 3) exposed at an end (front end portion) of the coaxial wire 4 is connected to the internal conductor connection portion 70*a*. At the end of the coaxial wire 4, as shown in FIGS. 3 and 4, a cylindrical sleeve 5 formed of a metal is crimped and fixed to an outer periphery of an exposed cylindrical braided conductor 4*b* at a position rearward than the exposed internal conductor 4*a*, and the braided conductor 4*b* located forward than the sleeve 5 is folded back to the rear side so as to cover an outer periphery of the sleeve 5.

Next, the female guide sleeve 80 will be described. As shown in FIGS. 3 and 4, the female guide sleeve 80 formed of an insulating resin has a stepped cylindrical shape extending in the front-rear direction. The female guide sleeve 80 includes a cylindrical large diameter portion 81 located at the rear side and a cylindrical small diameter portion 82 located at the front side and having a smaller diameter than the large diameter portion 81.

The female inner terminal 70 is inserted into the female guide sleeve 80 from the rear side. Further, the female guide sleeve 80 is inserted into the female outer terminal 90 from the rear side. As a result, the female guide sleeve 80 functions to insulate the female inner terminal 70 and the female outer terminal 90 from each other, and also to maintain a state in which the female inner terminal 70 and the female outer terminal 90 are arranged coaxially.

Next, the female outer terminal 90 will be described. As shown in FIGS. 3 and 4, the female outer terminal 90 formed of a metal has a stepped cylindrical shape extending in the front-rear direction. The female outer terminal 90 includes a cylindrical large diameter portion 91 located at the rear side and a cylindrical small diameter portion 92 located at the front side and having a smaller diameter than the large diameter portion 91. The small diameter portion 92 is provided with an elastic piece 92*a* formed into a cantilever shape (formed by so-called cutting and raising) so as to slightly protrude radially outward. The female outer terminal 90 is a member that exhibits the above-described shielding function of the counterpart connector 2. An outer diameter of the small diameter portion 92 is substantially the same as an inner diameter of the large diameter portion 31 of the male outer terminal 30, and the small diameter portion 92 can be inserted into the large diameter portion 31. A lance locking hole 93 (see FIG. 4) is formed in a lower portion of the large diameter portion 91. At the rear side of the large diameter portion 91, a braided conductor connection portion 91*a* and an outer sheath crimping portion 91*b* are provided in this order from the front side toward the rear side.

Next, an assembly procedure of the counterpart connector 2 will be described. In order to assemble the counterpart connector 2, first, as a preparation, the side holder 66 is attached to a lower portion of the female housing 60 from below so as to cover the lance 62, and the side holder 66 is locked at a temporary locking position (not shown). The fitting assurance member 67 is attached to an upper portion of the female housing 60 from a rear side so as to enter a lower space of the lock arm 63 and the fitting assurance member 67 is locked at a temporary locking position (not shown).

Next, at the rear side of the female inner terminal 70, the internal conductor 4*a* exposed at the end of the coaxial wire 4 is connected to the internal conductor connection portion 70*a*. Next, the female inner terminal 70 is inserted into the female guide sleeve 80 from the rear side, and is fixed to the female guide sleeve 80 by a predetermined fixing mechanism. Next, the female guide sleeve 80 is inserted into the female outer terminal 90 from the rear side, and is fixed to the female outer terminal 90 by a predetermined fixing mechanism.

As a result, the large diameter portion 81 and the small diameter portion 82 of the female guide sleeve 80 are respectively located inside the large diameter portion 91 and the small diameter portion 92 of the female outer terminal 90 (see FIG. 4). Further, the braided conductor 4*b* located on the outer periphery of the sleeve 5 that is fixed to an end of the coaxial wire 4 is connected to the braided conductor connection portion 91*a* of the large diameter portion 91 of the female outer terminal 90, and an outer sheath 4*c* of the coaxial wire 4 is fixed to the outer sheath crimping portion 91*b*. Further, the female inner terminal 70 is covered with the female outer terminal 90. Accordingly, the female outer terminal 90 exhibits a shielding function against the female inner terminal 70.

Next, the female outer terminal 90 is inserted into the female terminal accommodating hole 61 of the female housing 60 from the rear side. This insertion is continued until the lance locking hole 93 is engaged with the lance 62 (until the female outer terminal 90 reaches a proper insertion position).

Next, the side holder 66 located at the temporary locking position is pressed upward against the female housing 60, so that the side holder 66 is moved to a final locking position shown in FIG. 4 that is upward than the temporary locking position. The side holder 66 is held at the final locking position as shown in FIG. 4, so that the side holder 66 has a function of ensuring that the lance 62 is engaged with the lance locking hole 93 (that is, ensuring that the female outer terminal 90 is at a proper insertion position) and a function of preventing disengagement of the lance 62 and the lance locking hole 93 due to downward elastic deformation of the lance 62 (so-called double locking function). Then, the assembly of the counterpart connector 2 is completed.

As shown in FIGS. 1 and 2, the assembled counterpart connector 2 is fitted to the connector 1 mounted on the circuit board 3. The fitting is continued until the lock portion 14 of the male housing 10 is engaged with the locking portion 65 of the lock arm 63 of the female housing 60, so that the female housing 60 is inserted into the fitting recessed portion 11 of the male housing 10, the large diameter portion 31 of the male outer terminal 30 is inserted into the female terminal accommodating hole 61 of the female housing 60, and the small diameter portion 92 of the female outer terminal 90 is inserted into the large diameter portion 31 of the male outer terminal 30.

When the small diameter portion 92 of the female outer terminal 90 is inserted into the large diameter portion 31 of the male outer terminal 30, the elastic piece 92*a* (see FIG. 3) provided in the small diameter portion 92 comes into contact with the large diameter portion 31.

After the lock portion 14 is engaged with the locking portion 65 of the lock arm 63, the fitting assurance member 67 at the temporary locking position is pushed toward the male housing 10, so that the fitting assurance member 67 is moved to the final locking position shown in FIG. 4 that is forward than the temporary locking position. When the fitting assurance member 67 is held at the final locking position shown in FIG. 4, a rear end portion 68 of the fitting assurance member 67 enters a lower side of the operation portion 64 of the lock arm 63, and a tip end portion 69 of the fitting assurance member 67 is positioned forward than the locking portion 65. As a result, the fitting assurance member 67 has a function of ensuring that the lock portion 14 of the male housing 10 is engaged with the locking portion 65 (that is, ensuring that the male housing 10 and the female housing 60 are in a completely fitted state) and a function of preventing disengagement of the lock portion 14 and the locking portion 65 due to downward elastic deformation of the lock arm 63 (so-called double locking function). Then, fitting of the connector 1 and the counterpart connector 2 is completed (see FIG. 1).

In a state in which fitting of the connector 1 and the counterpart connector 2 is completed, the tip end portion 53 of the male inner terminal 50 and the female inner terminal 70 are electrically connected to each other. As a result, a high-frequency signal transmitted by the coaxial wire 4 is transmitted to the conductor pattern 3*a* of the circuit board 3 via the male inner terminal 50. Further, the small diameter portion 92 of the female outer terminal 90 and the large diameter portion 31 of the male outer terminal 30 are electrically connected to each other. As a result, a minute current generated in the female outer terminal 90 due to collection of electromagnetic waves by the female outer terminal 90 is grounded to the ground portions of the circuit board 3 via the male outer terminal 30 and the shield shell 20.

Next, the configuration of engagement portion 36 of male outer terminal 30 will be described in detail. Hereinafter, for the convenience of description, a "radial direction" and a "circumferential direction" of the male outer terminal 30 having a stepped cylindrical shape are respectively referred to as a "radial direction" and a "circumferential direction".

Figure 7:
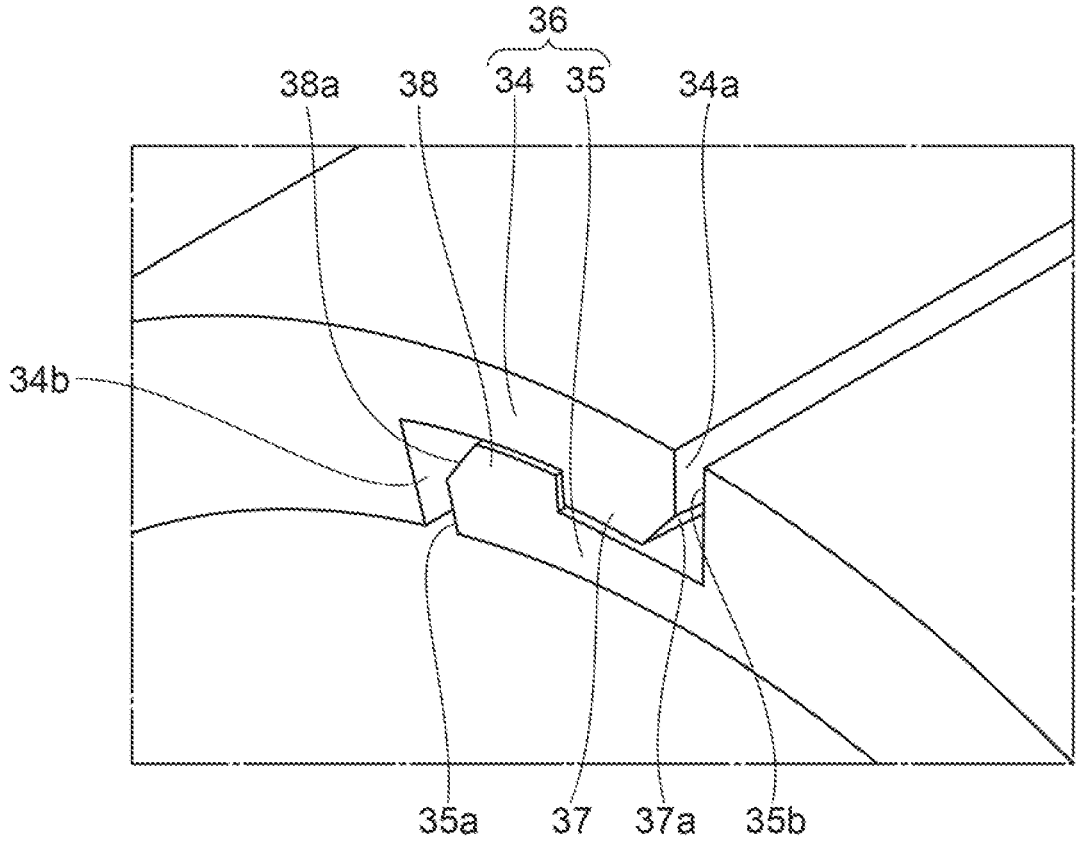
FIG. 7 is an enlarged view showing a portion C in FIG. 6A.

As shown in FIG. 7, the engagement portion 36 is configured such that a reduced thickness portion 34 (see FIGS. 8A and 8B) that is formed at an end of one edge portion extending in the front-rear direction of the conductor 30*a* (see also FIGS. 8A and 8B) and that extends in the front-rear direction and a reduced thickness portion 35 (see also FIGS. 8A and 8B) that is formed at an end of the other edge portion extending in the front-rear direction of the conductor 30*a* and that extends in the front-rear direction are engaged with each other such, so that the reduced thickness portion 34 is stacked (overlapped in the radial direction) on a radially outer side of the reduced thickness portion 35. The engagement portion 36 is continuous in the front-rear direction of the male outer terminal 30 (including the large diameter portion 31, the connection portion 33, and the small diameter portion 32).

As shown in FIG. 7, the reduced thickness portion 34 is a portion where the end of one end portion of the conductor 30*a* is reduced in thickness so as to be recessed radially outward. Thus, a stepped surface 34*b* that faces the circumferential direction and extends in the front-rear direction is formed on an inner peripheral surface of a boundary between the reduced thickness portion 34 and a portion where the thickness is not reduced at the one end portion of the conductor 30*a*. No step is formed on an outer peripheral surface of the boundary between the reduced thickness portion 34 and the portion where the thickness is not reduced at the one end portion of the conductor 30*a*. A tip end surface 34*a* in the circumferential direction of the reduced thickness portion 34 faces the circumferential direction and extends in the front-rear direction.

As shown in FIG. 7, the reduced thickness portion 35 is a portion where the end of the other end portion of the conductor 30*a* is reduced in thickness so as to be recessed radially inward. Thus, a stepped surface 35*b* that faces the circumferential direction and extends in the front-rear direction is formed on an outer peripheral surface of a boundary between the reduced thickness portion 35 and a portion where the thickness is not reduced at the other end portion of the conductor 30*a*. No step is formed on an inner peripheral surface of the boundary between the reduced thickness portion 35 and the portion where the thickness is not reduced at the other end portion of the conductor 30*a*. A tip end surface 35*a* in the circumferential direction of the reduced thickness portion 35 faces the circumferential direction and extends in the front-rear direction.

The tip end surface 34*a* of the reduced thickness portion 34 and the stepped surface 35*b* of the reduced thickness portion 35 face each other in the circumferential direction. The tip end surface 35*a* of the reduced thickness portion 35 and the stepped surface 34*b* of the reduced thickness portion 34 face each other in the circumferential direction. In other words, in the engagement portion 36, the reduced thickness portion 34 and the reduced thickness portion 35 face each other in the radial direction, the tip end surface 34*a* and the stepped surface 35*b* face each other in the circumferential direction, and the tip end surface 35*a* and the stepped surface 34*b* face each other in the circumferential direction, that a so-called labyrinth structure is formed.

In the present example, a radial thickness of each of the reduced thickness portion 34 and the reduced thickness portion 35 is substantially half a thickness of the portion where the thickness is not reduced (that is, a plate thickness of the conductor 30*a*). Therefore, a radial thickness of the engagement portion 36 formed by stacking the reduced thickness portion 34 and the reduced thickness portion 35 is substantially equal to the thickness of the portion where thickness is not reduced. Therefore, almost no step extending in the front-rear direction is formed at a portion corresponding to the engagement portion 36 on an outer peripheral surface and an inner peripheral surface of the male outer terminal 30 (including the large diameter portion 31, the connection portion 33, and the small diameter portion 32) (see FIGS. 6A, 6B and 7). Even when a step is formed, since edge portions with reduced thicknesses are stacked, a protruding height of the step is reduced as compared with a step formed in the above-described connector (in which edge portions are stacked without reducing thicknesses). That is, the degree of unevenness of the engagement portion 36 is smaller than that of the above-described connector in the related art.

As shown in FIG. 7, a protrusion 37 is formed on the inner peripheral surface of the tip end portion of the reduced thickness portion 34 in the circumferential direction, while protruding inwardly in the radial direction and extending in the front-rear direction. A protrusion 38 is formed on the inner peripheral surface of the tip end portion of the reduced thickness portion 35 in the circumferential direction, while protruding outwardly in the radial direction and extending in the front-rear direction. The protrusions 37 and 38 are at positions to offset and face each other so as to be engaged with each other in the circumferential direction.

Therefore, for example, in a state where the male outer terminal 30 is present alone, even when an external force is exerted to cause the engagement portion 36 to open (relatively move the reduced thickness portions 34 and 35 in the circumferential direction in the direction away from each other), with the protrusions 37 and 38 at the offset positions being engaged with each other, the engagement portion 36 is prevented from opening. Therefore, widening of a clearance between the reduced thickness portions 34 and 35 of the male outer terminal 30 is prevented, and decrease in the shielding performance of the male outer terminal 30 is prevented.

The protrusions 37 and 38 may or may not be in contact with each other in the circumferential direction. In addition, it is preferable that the radial thickness of the portion of the reduced thickness portion 34 where the protrusion 37 is formed is smaller than the thickness of the portion where the thickness is not reduced (that is, the plate thickness of the conductor 30*a*). Similarly, it is preferable that the radial thickness of the portion of the reduced thickness portion 35 where the protrusion 38 is formed is smaller than the thickness of the portion where the thickness is not reduced (that is, the plate thickness of the conductor 30*a*).

A corner portion of the protruding end of the protrusion 37, which is located closer to the tip end surface 34*a* and extended in the front-rear direction, includes a tapered surface (chamfer) 37*a* formed thereon. A corner portion of the protruding end of the protrusion 38, which is located closer to the tip end surface 35*a* and extended in the front-rear direction, includes a tapered surface (chamfer) 38*a* formed thereon.

As described above, according to the connector 1 in the present embodiment, the male outer terminal 30 is formed by bending the plate-shaped conductor 30*a* into a cylindrical shape and engaging one and the other edge portions with each other, thus exhibiting a shielding function of shielding (collecting) electromagnetic waves. The engagement portion 36 formed by engaging one and the other edge portions with each other has a so-called labyrinth structure in which the reduced thickness portion 34 where an end portion in the circumferential direction of the one edge portion is reduced in thickness so as to be recessed radially outward and the reduced thickness portion 35 where an end portion in the circumferential direction of the other edge portion is reduced in thickness so as to be recessed radially inward overlap with each other in the radial direction. Accordingly, a radial thickness of the engagement portion 36 can be made substantially equal to a plate thickness of the plate-shaped conductor 30*a*, and thus the above-described step can be eliminated on an outer peripheral surface of the male outer terminal 30. As a result, it is not necessary to form a step on the inner wall surface of the male terminal accommodating hole 13 for holding the small diameter portion 32 of the male outer terminal 30 in the male housing 10, and the structure of the mold or the like for molding the male housing 10 can be simplified as compared with the connector in the related art.

Further, the protrusion 37 protruding inwardly in the radial direction of the reduced thickness portion 34 and the protrusion 38 protruding outwardly in the radial direction of the reduced thickness portion 35 are at positions to offset and face each other so as to be engaged with each other in the circumferential direction. As a result, even when an external force is exerted to cause the engagement portion 36 to open (relatively move the reduced thickness portions 34 and 35 in the circumferential direction in the direction away from each other), with the protrusions 37 and 38 at the offset positions being engaged with each other, the engagement portion 36 is prevented from opening. Therefore, widening of the clearance between the overlapped, reduced thickness portions 34 and 35 of the male outer terminal 30 is prevented, and decrease in the shielding performance of the male outer terminal 30 is prevented.

Further, since the engagement portion 36 of the male outer terminal 30 has the labyrinth structure, a creepage distance at the reduced thickness portions 34 and 35 overlapping with each other is increased, and the shielding performance is improved. In addition, the thickness of the engagement portion 36 is set to be substantially equal to the plate thickness of the plate-shaped conductor 30*a*, so that an outer peripheral surface of the small diameter portion 32 of the male outer terminal 30 is less likely to be caught by the male housing 10 when the small diameter portion 32 of the male outer terminal 30 is inserted into the male terminal accommodating hole 13 of the male housing 10, and insertability of the male outer terminal 30 into the male housing 10 is improved.

Further, according to the connector 1 in the present embodiment, the male outer terminal 30 includes the large diameter portion 31 and the small diameter portion 32 having a smaller diameter than the large diameter portion 31 and held in the male housing 10. Therefore, when the small diameter portion 32 of the male outer terminal 30 is inserted into the male housing 10, the connection portion 33 between the large diameter portion 31 and the small diameter portion 32 is pressed against the male housing 10, so that the male outer terminal 30 can be properly positioned in an insertion direction of the male outer terminal 30 into the male housing 10. As a result, the manufacture of the connector 1 is further simplified. Further, the engagement portion 36 extends in an axial direction crossing over both the large diameter portion 31 and the small diameter portion 32, so that the above-described step can be eliminated on an outer peripheral surface of the connection portion 33 in addition to the large diameter portion 31 and the small diameter portion 32. As a result, positioning accuracy of the male outer terminal 30 in an insertion direction into the male housing 10 is improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

In the embodiments described above, the male outer terminal 30 has a stepped cylindrical shape and includes the large diameter portion 31 and the small diameter portion 32. Alternatively, the male outer terminal 30 may have a cylindrical shape having a constant outer diameter in the front-rear direction.

According to the above exemplary embodiments, the connector (1) comprises:

a cylindrical terminal (30) to be electrically connected with a cylindrical counterpart terminal (90);

an internal terminal (50) located in the cylindrical terminal (30); and a housing (10) holding the cylindrical terminal (30).

The cylindrical terminal (30) has an engagement portion (36) configured by bending a conductor (30*a*) having a plate-shape into a cylindrical shape to engage one edge portion of the conductor (30*a*) and an opposite other edge portion of the conductor (30*a*).

The one edge portion has a recessed shape at its circumferential end portion by reducing its thickness outwardly in a radial direction of the cylindrical terminal (30) to configure a first reduced thickness portion (34).

The first reduced thickness portion (34) has a first protrusion (37) protruding inwardly in the radial direction and extending in an axial direction of the cylindrical terminal (30).

The other edge portion has a recessed shape at its circumferential end portion by reducing its thickness inwardly in the radial direction to configure a second reduced thickness portion (35).

The second reduced thickness portion (35) has a second protrusion (38) protruding outwardly in the radial direction and extending in the axial direction.

The engagement portion (36) is configured by overlapping the first reduced thickness portion (34) and the second reduced thickness portion (35) in the radial direction and further by locating the first protrusion (37) and the second protrusion (38) to face each other in the circumferential direction to allow an engagement between the first protrusion (37) and the second protrusion (38) in the circumferential direction.

According to the connector having the above configuration, the cylindrical terminal has a structure in which the plate-shaped conductor is bent into a cylindrical shape and the one and the other edge portions are engaged with each other, and the cylindrical terminal exhibits a shielding function of shielding (collecting) electromagnetic waves by isolating the internal terminal from the periphery. The engagement portion formed by engaging the one and the other edge portions with each other has a configuration is which the reduced thickness portion where an end portion in the circumferential direction of the one edge portion is reduced in thickness so as to be recessed radially outward, and the reduced thickness portion where an end portion in the circumferential direction of the other edge portion is reduced in thickness so as to be recessed radially inward overlap with each other in the radial direction. That is, since the engagement portion has a so-called labyrinth structure, a creepage distance is increased, and the shielding performance of the engagement portion is improved. Further, since the thickness reduced portions overlap with each other, it is possible to reduce an influence of the engagement portion on the appearance of the cylindrical terminal (that is, to reduce the degree of unevenness).

Further, the protrusion protruding inwardly in the radial direction of one edge portion, and the protrusion protruding outwardly in the radial direction of the other edge portion are at positions to face each other so as to be engaged with each other in the circumferential direction. With this engagement, it is possible to prevent widening or narrowing of a clearance in the engagement portion due to a dimensional tolerance (so-called manufacturing variation) that may occur at the time of manufacturing the cylindrical terminal. Furthermore, it is possible to prevent the engagement portion from being opened due to an unintended external force applied to the cylindrical terminal. Therefore, in the connector having the configuration described above, the cylindrical terminal can appropriately exhibit the shielding performance as designed.

As a result, it is easier to improve productivity of the connector by preventing complication of a mold or the like for manufacturing the housing, while preventing a decrease in the shielding performance of the contact portion. Therefore, the connector having the configuration according to the embodiments can achieve both excellent shielding performance and improvement in productivity as compared with the connector in the related art.

In the connector (1), the cylindrical terminal (30) may have: a large diameter portion (31) to contact with the counterpart terminal (90); and a small diameter portion (32) having a smaller diameter than the large diameter portion (31) and held in the housing (10).

The engagement portion (36) may extend in the axial direction across over both of the large diameter portion (31) and the small diameter portion (32).

According to the connector having the above configuration, the cylindrical terminal includes the large diameter portion and the small diameter portion. Therefore, when the small diameter portion of the cylindrical terminal is inserted into the housing, a boundary portion (that is, a connection portion) between the large diameter portion and the small diameter portion is pressed against the housing, so that the cylindrical terminal can be positioned in the housing. Accordingly, a work of assembling the cylindrical terminal to the housing is facilitated, and productivity of the connector can be further improved. Further, since the engagement portion is formed crossing all over the large diameter portion and the small diameter portion, it is possible to reduce the degree of unevenness of an outer peripheral surface of the connection portion in addition to the large diameter portion and the small diameter portion. As a result, accuracy of positioning described above is improved. Therefore, the connector having the configuration can have further improved productivity.

As described above, according to the present invention, it is possible to provide a connector that can achieve both excellent shielding performance and improvement in productivity.

What is claimed is:

1. A connector comprising:

a cylindrical terminal to be electrically connected with a cylindrical counterpart terminal;

an internal terminal located in the cylindrical terminal; and a housing holding the cylindrical terminal, the cylindrical terminal having an engagement portion configured by bending a conductor having a plate-shape into a cylindrical shape to engage one edge portion of the conductor and an opposite other edge portion of the conductor, the one edge portion having a recessed shape at its circumferential end portion by reducing its thickness outwardly in a radial direction of the cylindrical terminal to configure a first reduced thickness portion, the first reduced thickness portion having a first protrusion protruding inwardly in the radial direction and extending in an axial direction of the cylindrical terminal, the other edge portion having a recessed shape at its circumferential end portion by reducing its thickness inwardly in the radial direction to configure a second reduced thickness portion, the second reduced thickness portion having a second protrusion protruding outwardly in the radial direction and extending in the axial direction, the engagement portion being configured by overlapping the first reduced thickness portion and the second reduced thickness portion in the radial direction and further by locating the first protrusion and the second protrusion to face each other in the circumferential direction to allow an engagement between the first protrusion and the second protrusion in the circumferential direction.

2. The connector according to claim 1, wherein the cylindrical terminal has: a large diameter portion to contact with the counterpart terminal; and a small diameter portion having a smaller diameter than the large diameter portion and held in the housing, the engagement portion extends in the axial direction across over both of the large diameter portion and the small diameter portion.

3. The connector according to claim 2, wherein the cylindrical terminal has a connection portion located between the large diameter portion and the small diameter portion and having a diameter gradually decreasing from the large diameter portion toward the small diameter portion, the engagement portion extends continuously in the axial direction of the cylindrical terminal over the large diameter portion, the connection portion, and the small diameter portion.

4. The connector according to claim 3, wherein the smaller diameter portion is inserted into a terminal accommodating hole provided with the housing and the connection portion is pressed against an edge portion of an opening of the terminal accommodating hole to allow the cylindrical terminal to be positioned in the housing in the axial direction.

5. The connector according to claim 1, wherein the first reduced thickness portion of the one edge portion and the second reduced thickness portion of the other edge portion each extend along an entire length of the cylindrical terminal, the entire length of the cylindrical terminal is along the axial direction, which is perpendicular to both the radial direction and the circumferential direction of the cylindrical terminal.

* * * * *